US006427940B1

(12) United States Patent
Koutonen et al.

(10) Patent No.: US 6,427,940 B1
(45) Date of Patent: Aug. 6, 2002

(54) METHOD AND DEVICE IN WINDING OF A WEB

(75) Inventors: Pauli Koutonen, Jokela; Jari Paanasalo, Järvenpää; Arto Leskinen, Nukari, all of (FI)

(73) Assignee: Metso Paper, Inc., Helsinki (FI)

( * ) Notice: Subject to any disclaimer, the term of this patent is extended or adjusted under 35 U.S.C. 154(b) by 0 days.

(21) Appl. No.: 09/445,137

(22) PCT Filed: Jun. 1, 1998

(86) PCT No.: PCT/FI98/00463

§ 371 (c)(1),
(2), (4) Date: Dec. 2, 1999

(87) PCT Pub. No.: WO98/55385

PCT Pub. Date: Dec. 10, 1998

(30) Foreign Application Priority Data

Jun. 3, 1997 (FI) ..... 972353

(51) Int. Cl.[7] ..... B65H 18/26
(52) U.S. Cl. ..... 242/541.5
(58) Field of Search ..... 242/520, 540, 242/541, 541.5, 541.6, 547

(56) References Cited

U.S. PATENT DOCUMENTS

| | | | | |
|---|---|---|---|---|
| 3,837,593 A | 9/1974 | Dörfel | ..... | 242/66 |
| 3,977,619 A | 8/1976 | Nagata et al. | ..... | 242/67.1 |
| 4,811,915 A | 3/1989 | Smith | ..... | 242/66 |
| 4,867,387 A | 9/1989 | Schönmeier | ..... | 242/65 |
| 4,883,233 A | 11/1989 | Saukkonen et al. | ..... | 242/66 |
| 4,932,599 A | 6/1990 | Doerfel | ..... | 242/56.4 |

FOREIGN PATENT DOCUMENTS

| | | | | |
|---|---|---|---|---|
| EP | 0399370 | 11/1990 | ..... | B65H/18/26 |
| GB | 1309008 | 3/1973 | ..... | B65H/25/20 |
| WO | 9315009 | 1/1993 | ..... | B65H/18/26 |
| WO | 9532908 | 5/1995 | ..... | B65H/18/14 |
| WO | 9747544 | 6/1997 | ..... | B65H/18/26 |

*Primary Examiner*—Donald P. Walsh
*Assistant Examiner*—Mark J. Beauchaine
(74) *Attorney, Agent, or Firm*—Steinberg & Raskin, P.C.

(57) ABSTRACT

The invention concerns a method in winding of a web in a centre-drive winder, wherein the roll that is being formed is loaded and/or supported by means of a rider roll unit (40) whose position can be varied and which consists of at least two rolls (42). In the method, the force that is applied by the rider roll unit (40) to the roll face in the radial direction and/or the distribution of said force between the rolls (42) in the rider roll unit (40) is/are measured by means of a detector of detectors (31 . . . 36) directly connected with the winding head of the rider roll unit (40). The nip force of the rolls (42) in the rider roll unit (40) and/or the distribution of said nip force is/are regulated on the basis of the measurement signal given by the detectors.

12 Claims, 4 Drawing Sheets

FIG. 3A
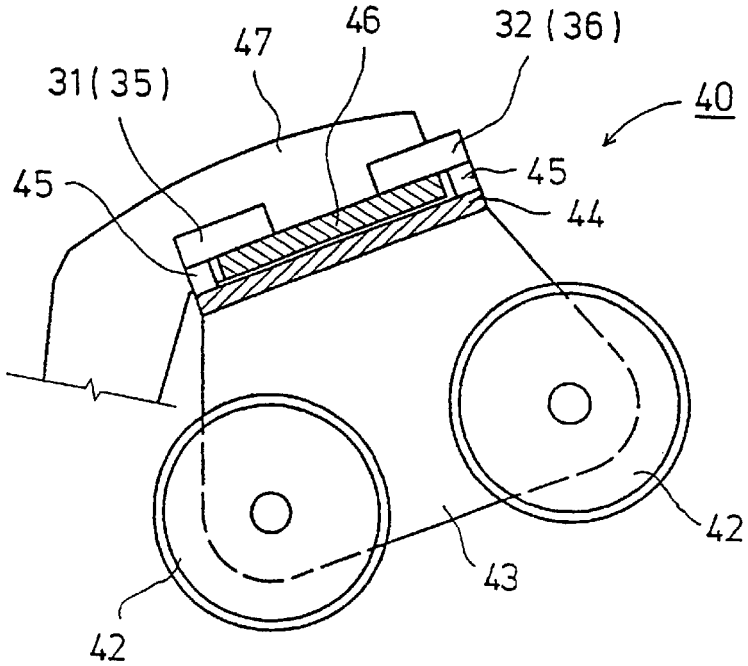
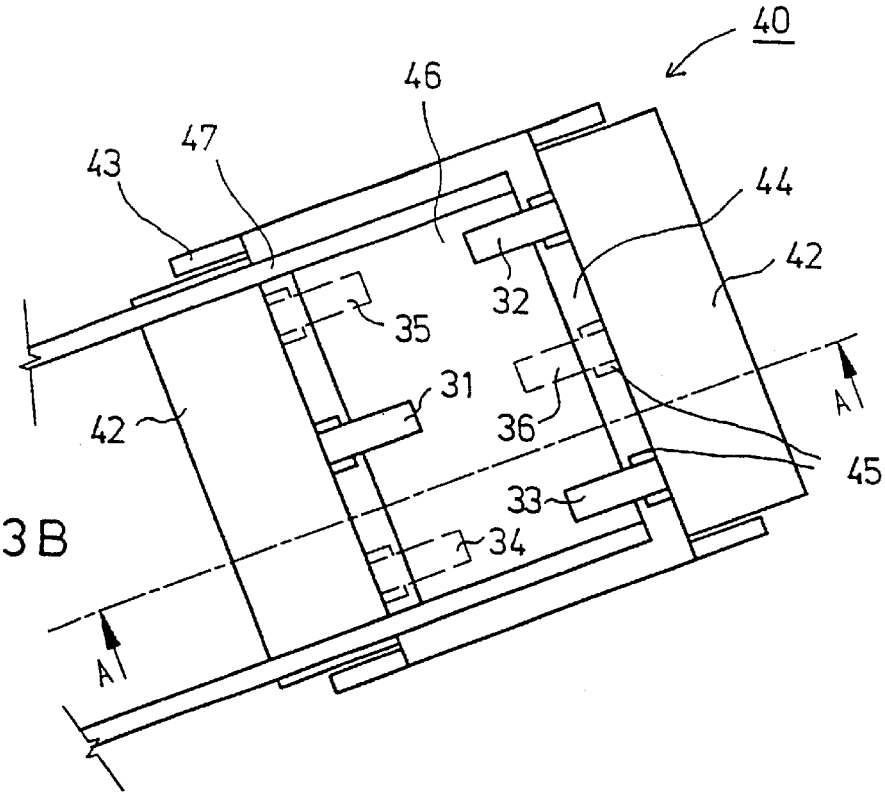
FIG. 3B

METHOD AND DEVICE IN WINDING OF A WEB

FIELD OF THE INVENTION

The present invention relates to a method and device for winding a web in a paper machine.

BACKGROUND OF THE INVENTION

With respect to the prior art related to the present invention, reference can be made. to the applicant's FI Patent Application 942451, in which a. method and a device in winding of a web, are described. In said method, a web is wound onto, a spool on support of a support roll while the web is passed through a. nip formed between the support roll and the roll that is being produced. In the method, the spool is supported at least partly, and the spool/roll is supported and/or loaded by means of a device whose position can be shifted. In the method, in the initial stages of winding, the loading/support unit/units in said device is/are shifted substantially in a plane passing through the axes of the support roll and of the roll that is being produced as a linear movement so as to load and/or to support the roll that is being produced the winding position. When the winding makes progress, the loadmg/support unit/units of the device is/are shifted downwards along a path substantially parallel to the circumference of the roll, and, in the final stage of winding the roll that is being completed is supported from below by means of said unit.

On the other hand, in the device in accordance with said FI Patent Application No. 942451, the web is wound onto. a spool while supported by a roll and while passed through a nip formed between the support roll and the roll that is being produced. Said spool is at least partly supported by means of a support device fitted in the centre of the spool. Further, the device comprises a unit for supporting the spool and for loading the roll. Said unit has been fitted as a combined loading/supporting and surface-drive member. The device also comprises members, for shifting the unit substantially in a plane passing through the axes of the support roll and of the roll that is being produced. as a linear movement, on one hand, and substantially along a curved path in the direction of the circumference of the roll, on the other hand.

In the applicant's Finnish patent application "Device in winding of a web", to be filed on the same day with the present patent application, a solution is described in which an improvement is suggested for the applicant's said FI Patent Application 942451. In said suggestion of improvement, the rolls of the loading/support and surface-drive member have been coupled together by means of coupling members so that movements of the rolls in relation to one another are geometrically positively controlled.

With respect to the prior art related to the present invention, reference is made to the publication U.S. Pat. No. 4,883,233, which discloses a method and device in winding a web onto a spool for forming a web roll and comprising a support roll, a rider roll unit with two rider rolls and a rider belt and means for supporting the spool. Further, there are disclosed means for measuring a force applied by the rider roll unit to the web roll.

With respect to the prior art related to the present invention, reference can also be made to the published DE Patent Application 3737503, in which a rigid rider roll unit connected with a reel slitter machine is described, whose loading is based on loading by means of a rocker arm. By means of this prior-art arrangement, the factual effective forces cannot be found out, nor has an arrangement for regulation of the load been suggested in it.

It is a common problem of the prior-art devices mentioned above that the force that is applied by the rider roll/set of rider rolls to the roll that is being formed is not known sufficiently precisely. This force is, as a rule, measured from some articulated joint in the support structure of the rider roll unit. Then, from this measured value, by means of various approximations, the force applied by the rider roll to the web roll is computed. Since the construction of articulated joints that supports the rider roll unit always involves a play and since the relative positions of the articulated arms in the construction of articulated joints are changed when the rider roll unit is shifted to different positions, the result of the computing is unavoidably inaccurate. The error is increased by the fact that the prior-art force measurement detectors measure the force in one fixed direction, in which case, since the direction of the effective force is varied when the support structure moves, the change in direction must be taken into account when the measured signal is processed.

A second factor that causes an error in the measurement of force when the measurement is made from some articulated joint of the articulation structure that supports the rider roll unit is the weight of the rider roll unit and of the articulation structure that supports the unit. The weight of the rider roll unit and of the articulation structure that supports the unit is considerable in comparison to the linear load that is aimed at between the rider roll unit and the roll that is being formed. Further, in such measurement, it must be taken into account that the force applied by the weight of the rider roll unit to the roll varies along with the position of the rider roll unit. Thus, out of the measurement results. it would be necessary to be able to separate the errors arising from said factors, but this is difficult in practice.

OBJECTS AND SUMMARY OF THE INVENTION

Further, the measurement mentioned above, in which the force applied by the rider roll to the web roll is measured from some articulated joint in the articulation structure that supports the rider roll unit, involves the drawback that by its means it is impossible to find out the distribution of the force between the rolls in the rider roll unit. When the rider roll unit is attached rigidly to its pivot arms, very precise positioning devices are needed to align the roll/set of rolls against the web roll in the desired way. In particular, when two rolls are employed., even a little error in the position has the consequence that one of the rolls presses the web roll with a greater force than the other one, i.e. the load is not symmetric. In such a case, at the maximum, a higher linear force is applied to the web roll than if both rider rolls loaded the web roll with equal forces, which has an effect on the structure of the roll that is formed.

The object of the present invention is to suggest a method and a device in relation to winding, in which method and device it is possible to measure precisely the factual forces between the rolls of the rider roll- unit and the roll that is being formed and, thereby, to provide regulation of load and/or regulation of position.

In the solution in accordance with the invention; the winding head of the rider roll unit is provided with a detector or detectors, by whose means the nip force between the rolls of the rider roll unit and the roll that is being formed and/or the distribution of the nip force can be measured. Based on the measurement result received from the detectors, the logic determines the regulation parameters for the loading and/or positioning means, in which connection it is possible to regulate the force of contact of the rider roll unit precisely in the direction of the radius of the web roll by means of a feedback-connected regulation. Further, by means of the detectors, the contact forces of each roll are found out separately, which permits an overall control of the profile of nip contact between the rolls during winding. If the rolls load the web roll unevenly because of a somewhat incorrect position of a rigid set of rolls, the situation is amended by running the set of rolls into a correct position, based on the measurement results that have been obtained.

As the detectors are placed in the winding head of the rider roll unit, they are placed as close to the contact point between the rolls of the rider roll unit and the roll that is being formed as possible, in which case the factual nip load between the rolls and the web roll and the distribution of said load are transmitted to the detectors. The more accurate measurement of the forces between the rider roll unit and the web roll has again the consequence that the regulations of the rider roll unit are carried out based on the factual situation prevailing in the web roll, and in this way it is possible to form better rolls, i.e. the quality of winding is improved.

In the present invention, the measurement of the force always takes place in the direction of the straight line passing through the centre point of the straight line that interconnects the centres of the rider rolls and through the centre point of the roll that is being formed. This is why the measurement always gives a correct result irrespective of the position in which the rider roll unit is placed on the face of the web roll.

When no drive has been switched on in the roll or rolls of the rider roll unit, the force measured from the winding head of the rider roll unit is directly the force applied by the rider roll unit to the web roll. If the drive has been switched on in the rider roll or rolls, a surface drive is applied by the belt that surrounds the rider rolls to the roll that is being formed. This surface drive again causes a torque in the winding head, which torque is seen in the force measurements. The torque produced by this surface drive can be determined from the power taken by the drive motors of the roll or rolls, and it can be taken into account in the measurement results.

When the rider roll unit is used at the side of the web roll and for supporting the web roll, the distribution of load is regulated by regulating the vertical position of the rider roll unit so that the desired distribution of load is accomplished between the rolls, which distribution is measured and regulated by means of the detectors.

BRIEF DESCRIPTION OF THE DRAWINGS

In a simpler embodiment of the invention, the arrangement has been fitted in connection with two rigidly fixed rolls, wherein the rolls have been mounted fixedly with one another. The invention is also suitable for use in connection with a rider roll unit in which an endless belt has been fitted running around the rolls of the rider roll unit, in which case the rolls are mobile in relation to one another so as to tighten the belt, but the roll unit as a whole is rigid. If the invention is applied with a rider roll unit provided with belts and rolls, a regulation of tension of their own is provided for the rolls so that the belt tension can be regulated in the desired way.

In the following, the invention will be described in more detail with reference to the figures in the accompanying drawing, the invention being by no means supposed to be strictly confined to the details of said illustrations.

FIGS. 3A and 3B are schematic illustrations of a second exemplifying embodiment of a rider roll unit to which the invention can be applied; FIG. 3B is viewed from above, and FIG. 3A is a sectional side view taken along the line A—A in FIG. 3B.

DETAILED DESCRIPTION OF THE INVENTION

Figure 1:
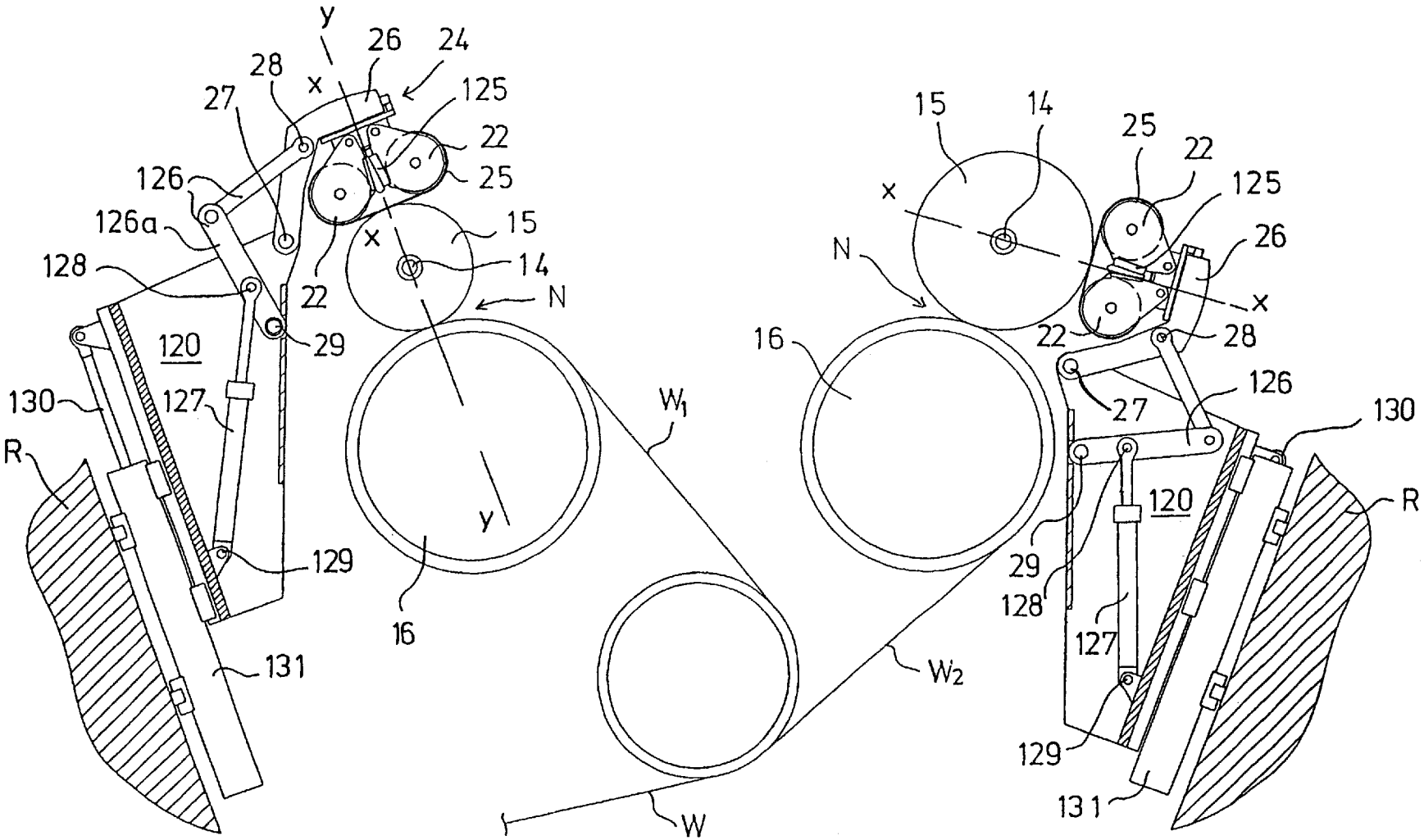
FIG. 1 is a schematic vertical sectional view of an exemplifying embodiment of the invention.

FIG. 1 shows an exemplifying embodiment in which the web W is wound by means of a what is called centre-drive winder. The web W, for example a paper or board web, is wound by means of a support roll 16 around a spool 14 to make a web roll 15, the web passing through the nip N formed between the support roll 16 and the roll 15 that is being produced. The spool 14 is connected with the other constructions of the winder in compliance with the centre-drive winder technique in itself known to a person skilled in the art (not shown in the illustration). The figure illustrates the winding of a web W onto two rolls 15 by means of two support rolls 16 in a winder device. In view of illustrating the operation of the rider roll device, the web rolls on the different support rolls 16 have been illustrated as being in different winding stages. Thus, the web W comes from the machine reel as slit component webs $W_1$, $W_2$, of which every second component web $W_1$ is wound by means of the winder placed at the left side in the figure, and every second component web $W_2$ is wound by means of the winder placed at the right side in the figure The closer details of the device and its principle of operation come out from the applicant's said FI Patent Application 942451.

As is shown in FIG. 1, the rider roll unit, i.e. the combined loading and/or support unit 24, consists of two rolls 22, around which an endless belt/belts 25 has/have been fitted running. One or both of the rolls 22 has/have been coupled in engagement with a drive in order to rotate the rolls 22 and the belt 25. The rider roll unit 24 is provided with an arrangement for regulation of the tension of the belt/belts 25.

The support construction 26 of the loading and/or support unit 24 is attached to a sledge unit 120 by means of an articulated joint 27. Further, the support construction 26 is connected with the sledge construction 120 by means of an articulated support arm 126, one of whose ends is connected to the support construction 26 by means of an articulated joint 28, and the other end to the sledge construction 120 by means of an articulated joint 29. To the articulated support arm 126, to its part 126*a* placed next to the sledge construction 120, a loading cylinder 127 is connected by means of an articulated joint 128. The opposite end of the loading cylinder 127 is connected to the sledge construction 120 by means of an articulated joint 129. By means of the loading cylinders 127 and 130, it is possible to displace the loading and/or support unit 24 along a path parallel to the circumference of the roll 15. By means of the loading cylinder 127, the desired loading and/or support is also provided for the roll 15. The sledge construction 120 can be displaced in the direction of growth of the roll 15, i.e. in the direction of the straight line Y—Y passing through the centre of the support roll 16, through the centre of the roll 15, and through the centre point of the straight line between the centres of the rolls 22 in the loading and/or support unit 24, by means of the cylinder 130. The sledge construction 120 is attached to an auxiliary sledge 131 as sliding, which auxiliary sledge 131 is again attached to the frame R of the winding device.

Figure 2:
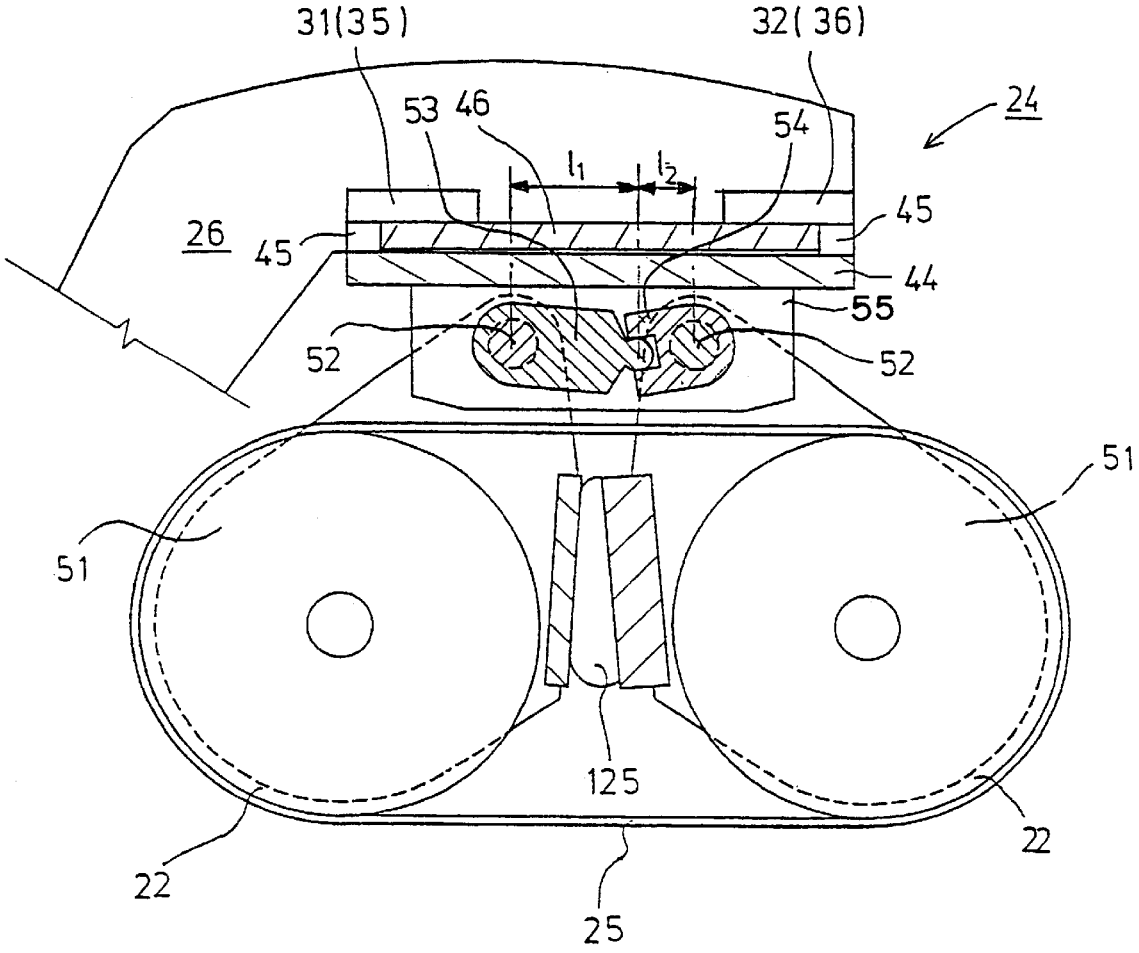
FIG. 2 is a schematic sectional view of an exemplifying embodiment of a rider roll unit to which the invention can be applied.

FIG. 2 is a schematic sectional view of a loading and/or support unit 24 for use in the device shown in FIG. 1, to which unit the measurement of force in accordance with the present invention can be applied. In this embodiment, the rolls 22 have been mounted from both ends on arms 51, which have been arranged to be pivotal around shafts 52. One shaft 52 is provided with a coupling member 53, which has been fitted into a coupling member 54 connected with the other shaft 52. Thus, movements of rotation of the shafts 52 are interconnected, and the rolls 22 move in relation to one another as geometrically positively controlled. By means of the bellows 125, it is possible to control the mutual distance between the rolls 22. The articulation point between the coupling members 53,54 can be placed at the centre point of the straight line between the centres of the shafts 52, in which case $l_1=l_2$. In such a case, the rolls 22 move symmetrically in relation to the straight line X—X drawn through the centre point of the straight line between the centres of the rolls 22 and through the centre of the web roll 15. If $l_1<>l_2$, the rolls 22 move asymmetrically in relation to said straight line X—X with the transmission ratio determined by the distances. The shafts 52 have been attached to an auxiliary frame 55, which has again been attached to a first frame plate 44, which is provided with projections 45. To the projections 45, force detectors 31 . . . 36 have been attached from one of their ends. To the support construction 26, a second frame plate 46 has been attached, to which the force detectors 31 . . . 36 are attached from their opposite ends. In respect of the force detectors, reference is also made to the following description related to FIGS. 3A . . . 3B.

In the exemplifying embodiment shown in FIGS. 3A . . . 3B, the winding head of the rider roll unit 40 comprises two rolls 42, which have been mounted on the side plates 43. The side plates 43 have been interconnected by means of the first frame plate 44, which is provided with projections 45. To the projections 45, force detectors 31 . . . 36 have been attached from one of their ends. To the support construction 47, the second frame plate 46 has been attached, to which the force detectors 31 . . . 36 are attached from their opposite ends. The winding head has been attached to the support construction 47 of the rider roll unit. From the roll, the radial nip force passes to the support construction 47 along the following path: roll 42, side plate 43, first frame plate 44, projection 45, detectors 31 . . . 36, and second frame plate 46. According to the invention, it is possible to use one or several force detectors.

When one detector is used, either the detector 31 or the detector 36 is used. By means of one detector, it is, as a rule, possible to measure a force in one direction only, and therefore it is preferable to use several detectors.

When two detectors are used, the detectors 31 and 36 are used. With two detectors, a considerably better idea of the nip forces and of their distribution is obtained.

According to the preferred embodiment, three detectors are used, i.e. the detectors 31 . . . 33 or 34 . . . 36. In such a case, a full idea of the nip forces and of their distribution is obtained. By means of three detectors, the distribution of forces of the rolls 22,42 of the rider roll unit 24,40 in the longitudinal direction is also found out. In this way it can be verified that the rolls 22,42 are, in the longitudinal direction, parallel to the winding core 14 and to the roll 15 that is being formed.

According to the invention, regulation of the nip force and of the distribution of nip forces in the rider roll unit 24,40 is achieved thereby that the winding head of the rider roll unit 24,40 is provided with detectors 31 . . . 36. The detector system may consist of one force detector 31 or favorably of two force detectors 31,36 and preferably of three force detectors (31 . . . 33), by whose means the force applied by the rider roll unit 24,40 to the roll 15 face in the radial direction and the distribution of said force between the rolls 22,42 of the rider roll unit 24,40 can be measured.

In spite of movement of the rider roll unit 24,40, the direction of measurement of forces by the detectors 31 . . . 36 remains constantly the same as the direction X—X of the nip force to be measured/regulated.

Figure 4A:
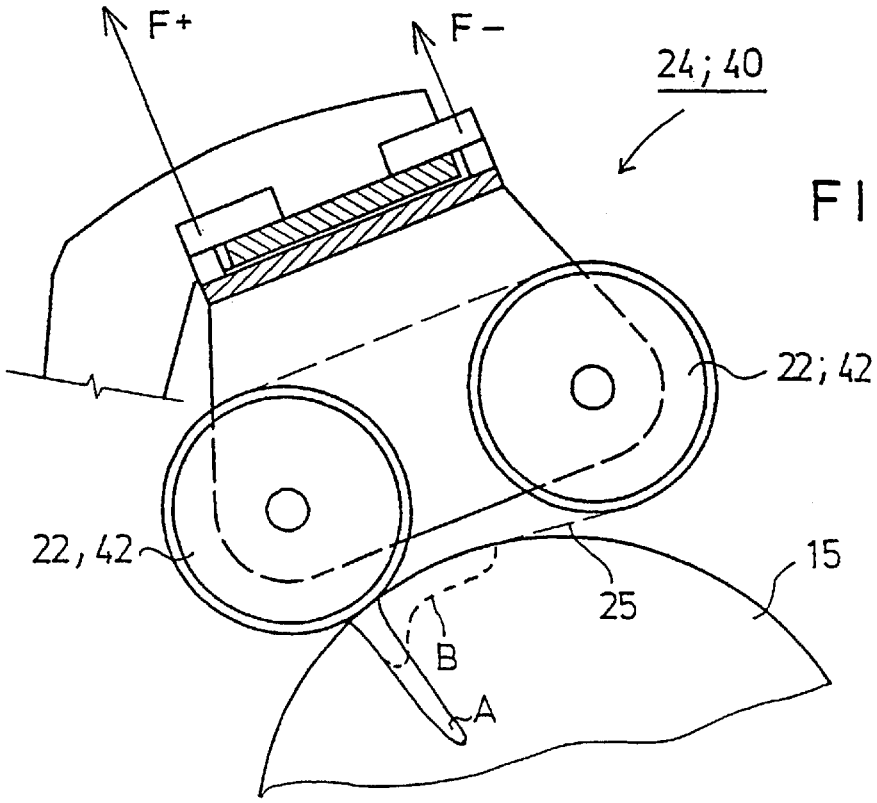
FIGS. 4A and 4B illustrate some incorrect positions of the rider roll unit on the web roll face and the distributions of forces arising from said positions.
Figure 4B:
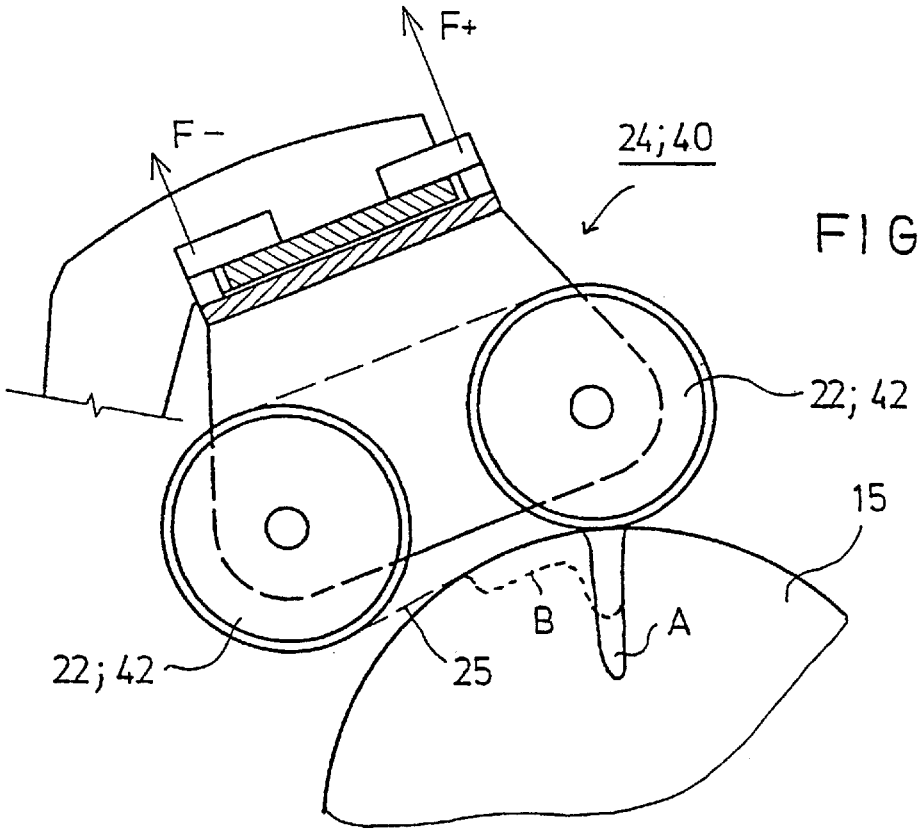

FIGS. 4A . . . 4B are schematic illustrations of two different incorrect positions of the rider roll unit 24,40 and of the forces F+, F− passed by said units to the detectors, line A. The dashed line represents a belt 25 that may be fitted in connection with the set of rolls 24 and the different nip force distribution given by the belt, dashed line B.

By means of a detector system in accordance with the invention, the contact force in the radial direction of the web roll can be regulated precisely by means of feedback-connected regulation. Further, by means of the detector system, the contact force of each roll 22,42 can be found out separately.

When the rider roll unit 24,40 is used at the side of the web roll 15 and for supporting the web roll 15, the distribution of loads is regulated by regulating the vertical position of the rider roll unit 24,40 so that the desired distribution of loads is obtained between the rolls 22. which distribution is measured and regulated by making use of the detector system 31 . . . 36. The desired distribution of loads in a rider roll unit 24 provided with a belt in respect of the rolls 22 and the belt 25 is regulated by regulating the tension of the belts 25.

Above, the invention has been described with reference to some preferred exemplifying embodiments of same only, the invention being, however, not supposed to be in any way strictly confined to the details of said embodiments. Many variations and modifications are possible within the scope of the inventive idea defined in the following patent claims.

We claim:

1. A device in winding of the web, which device is fitted to be used when a web (w) is wound onto a spool (14) when supported by the roll (16) and passing through a nip (N) formed between the roll (16) and the roll (15) that is being produced, which spool is at least partly supported by means of a support member placed in the center of the spool (14), which device is composed of at least one rider roll unit (24;40) in order to support the spool (14) and to load the roll (15), which rider roll unit (24;40) comprises at least two rolls (22;42), wherein the winding head of the rider roll unit (24;40) is provided with a detector or detectors (31 . . . 365), by whose means the force applied by the rider roll unit (24;40) to the roll (15) face in the radial direction and distribution of said force between the rolls (22;42) in the rider roll unit is measured.

2. A device as claimed in claim 1, wherein the winding head of the rider roll unit (24;40) is provided with two detectors (31,36), in which connection it is possible to measure the distribution of forces between the rolls (22;42) in the rider roll unit (24;40).

3. A device as claimed in claim 1, wherein the winding head of the rider roll unit (24;40) is provided with three detectors (31 . . . 33), in which connection it is also possible to measure the distribution of forces in the longitudinal direction of the rolls (22;42) in the rider roll unit (24;40).

4. A device as claimed in claim 1, wherein a belt (25), whose tension can be adjusted, has been arranged running around the rolls (22).

5. A method of winding a web onto a spool comprising the steps of:

arranging a rider roll unit to support said spool, said rider roll unit having a selectively variable position relative to said spool and comprising at least two rider rolls and a belt arranged around said at least two rider rolls, selectively applying a supporting force to said spool in a radial direction by controlling said position of said rider roll unit relative to said spool, measuring said force applied to said spool by detecting means to obtain an applied force measurement, said detecting means being mounted to a winding head of said rider roll unit, adjusting said supporting force on the basis of said applied force measurement by adjusting the position of said rider roll unit.

6. A method according to claim 5, wherein said detecting means comprises two detectors.

7. A method according to claim 5, wherein said detecting means comprises three detectors.

8. A method according to claim 5, wherein a tension of said belt is selected to provide a substantially rigid construction between said at least two rider rolls.

9. A device for supporting a spool onto to which a web is wound, said device comprising:

a rider roll unit structured and arranged to apply a supporting force to said spool in a radial direction relative to said spool, said rider roll unit having a selectively variable position and comprising at least two rider rolls, means for detecting said supporting force mounted to a winding head of said rider roll unit.

10. A device according to claim 9, wherein said means for detecting said supporting force comprises two detectors.

11. A device according to claim 9, wherein said means for detecting said supporting force comprises three detectors.

12. A device according to claim 9, wherein a belt having an adjustable tension is arranged around said at least two rider rolls.

* * * * *